US005801606A

United States Patent [19]

Schubert et al.

[11] Patent Number: 5,801,606

[45] Date of Patent: Sep. 1, 1998

[54] PSEUDO-ELLIPTICAL FILTER FOR THE MILLIMETER BAND USING WAVEGUIDE TECHNOLOGY

[75] Inventors: Jean-Denis Schubert, Verneuil/Seine; Jean-Claude Cruchon, Bouffemont, both of France

[73] Assignee: Alcatel Telspace, Nanterre, France

[21] Appl. No.: 763,130

[22] Filed: Dec. 11, 1996

[30] Foreign Application Priority Data

Dec. 12, 1995 [FR] France ..... 95 14703

[51] Int. Cl.[6] ..... H01P 1/208

[52] U.S. Cl. ..... 333/208; 333/212; 29/600

[58] Field of Search ..... 333/202, 208–212, 333/229, 230; 29/600

[56] References Cited

U.S. PATENT DOCUMENTS

| | | | |
|---|---|---|---|
| 2,749,523 | 6/1956 | Dishal | 333/212 |
| 4,167,713 | 9/1979 | Pfitzenmaier | 333/212 |
| 4,360,793 | 11/1982 | Rhodes et al. | 333/212 |
| 4,772,863 | 9/1988 | Rosenberg et al. | 333/208 X |
| 5,608,363 | 3/1997 | Cameron et al. | 333/202 |

FOREIGN PATENT DOCUMENTS

0075498A1 3/1983 European Pat. Off. .

OTHER PUBLICATIONS

*Patent Abstracts of Japan*, vol. 8, No. 25 (E–225) [1462], 2 Feb. 1984 corresponding to JP–A–58 187001 (Nippon Denki K.K.) dated Nov. 1, 1983.

*Patent Abstracts of Japan*, vol. 1, No. 156 (E–77) [8545], 13 Dec. 1977 corresponding to JP–A–52 100955 (Nippon Denki K.K.) dated 24 Aug. 1977.

*Primary Examiner*—Sgungsook Ham

*Attorney, Agent, or Firm*—Sughrue, Mion, Zinn, Macpeak & Seas, PLLC

[57] ABSTRACT

A pseudo-elliptical filter includes positively coupled resonant cavities, the signal input and the signal output of each cavity being at 90° to each other. At least one retro-coupling of signal between two of said cavities is constituted by a waveguide. Applications include pseudo-elliptical filters operating in the millimeter band.

16 Claims, 3 Drawing Sheets

PSEUDO-ELLIPTICAL FILTER FOR THE MILLIMETER BAND USING WAVEGUIDE TECHNOLOGY

BACKGROUND OF THE INVENTION

1. Field of the invention

The field of the invention is that of microwave filters and, more precisely, pseudo-elliptical filters for the millimeter band using waveguide technology.

2. Description of the prior art

Pseudo-elliptical filters have many advantages compared to conventional bandpass filters: they are simpler to adjust, have reduced losses and have a smaller number of poles. A waveguide technology pseudo-elliptical filter has a number of resonant cavities coupled together, for example by means of irises, and there is a certain number of retro-couplings between certain cavities. Pseudo-elliptical filters of this kind are described in the article "New types of waveguide bandpass filters for satellite transponders" by A. E. Atia and A. E. Williams, Comsat Technical Review, Vol. 1, No. 1, 1971.

A distinction is made in the remainder of this description between consecutive (positive) couplings that simply transmit the microwave signal between two neighboring cavities (with positive coupling the field lines are parallel and in the same direction in both cavities) and retro-couplings (non-consecutive couplings) in which the field lines, also parallel, are in opposite directions.

Retro-couplings implemented in the form of microstrip lines are known in themselves. Reference may be had, for example, to the article "Miniature dual mode microstrip filters" by J. A. Curtis and S. J. Fiedziusko, pages 443–446 of MTT-S Digest, IEEE, 1991. This solution is not optimal, however, when the filter is implemented in waveguide technology (i.e. using resonant cavities), as the technologies are not the same. It is therefore necessary to add microstrip lines, provide for impedance matching, etc. This increases cost and overall size.

U.S. Pat. No. 4 772 863 (Rosenberg et al) describes a pseudo-elliptical filter implemented in waveguide technology and also including retro-couplings. FIG. 1 shows one of these filters, comprising six cavities 10 through 15, the positive couplings 16 through 20 and the retro-couplings 21 through 24. It has a signal input E and a signal output S. A particular arrangement of the cavities 10 through 15 enables the provision of the retro-couplings 21 through 24 by simple irises between the cavities 10 and 13, 11 and 13, 13 and 15 and finally 10 and 15.

The drawback of this solution is that the signal inputs and outputs of each cavity are not at 90° to each other (here the angle between a signal input and a signal output is 120°), with the result that certain unwanted propagation modes are not eliminated. For example, when a filter of this kind is passing a $H_{011}$ main mode, the unwanted $E_{111}$ mode—which is the most troublesome since it is at the same frequency as the $H_{011}$ mode—is not eliminated in the filter output signal S.

Moreover, the relative positions of the various cavities are dictated by the characteristics of the filter to be obtained. It is therefore necessary to review the arrangement of the cavities for any new filter type.

Finally, it is not possible to implement all kinds of retro-coupling (for example, it is not possible to retro-couple cavities 12 and 15).

One objective of the present invention is to remedy these drawbacks.

To be more precise, one objective of the invention is to provide a pseudo-elliptical filter for the millimeter band implemented in waveguide technology in which the signal inputs and outputs of each cavity are at 90° to each other and in which the retro-couplings between cavities are implemented without using any other technology, in such a way as to reduce the cost and the overall size and to facilitate the implementation of the filter.

Another objective of the invention is to provide a filter of this kind in which the retro-couplings are not dictated by a particular arrangement of the cavities.

SUMMARY OF THE INVENTION

These objectives, and others that will emerge below, are achieved by a pseudo-elliptical filter comprising positively coupled resonant cavities, the signal input and the signal output of each cavity being at 90° to each other, and at least one retro-coupling constituted by a waveguide between two of said cavities.

The length and the cross-section of said waveguide are optimized so that there is real retro-coupling between the cavities that it connects, i.e. at the interfaces between the cavities and the waveguide the field lines are parallel and in opposite directions.

The waveguide can have iris ports and in this case the retro-coupling is effected at the level of a magnetic field.

The waveguide can instead have pin ports and in this case the retro-coupling is effected at the level of an electric field.

Other features and advantages of the invention will emerge from a reading of the following description of a preferred embodiment given by way of non-limiting illustrative example and from the accompanying drawings.

BRIEF DESCRIPTION OF THE DRAWINGS

FIG. 3 is perspective view of one half-shell of a pseudo-elliptical filter with eight cavities according to the present invention.

DETAILED DESCRIPTION OF THE PREFERRED EMBODIMENT

Figure 1:
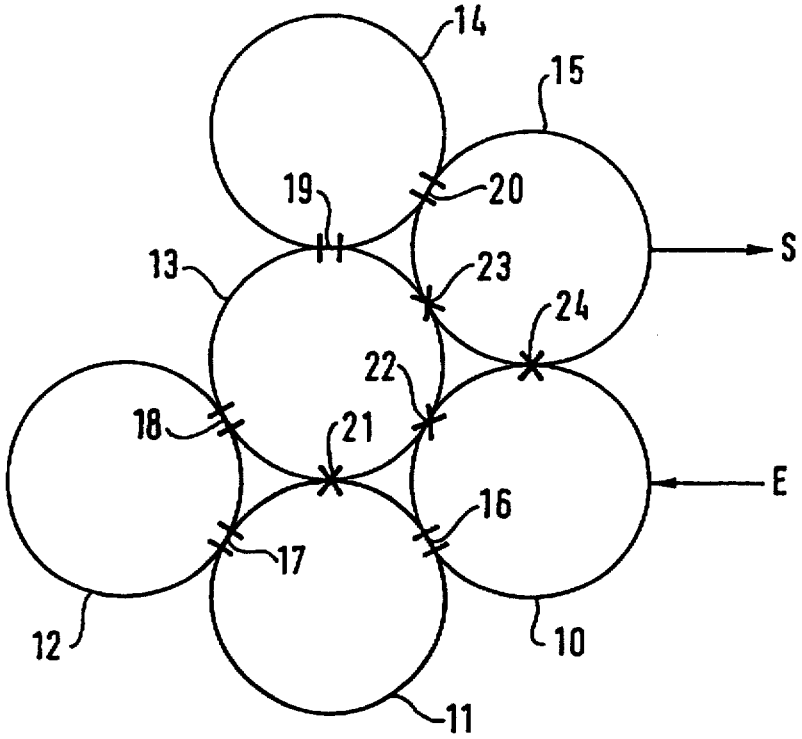
FIG.1 PRIOR ART
FIG. 1 shows a prior art pseudo-elliptical filter.

FIG. 1 has already been described with reference to the prior art.

Figure 2:
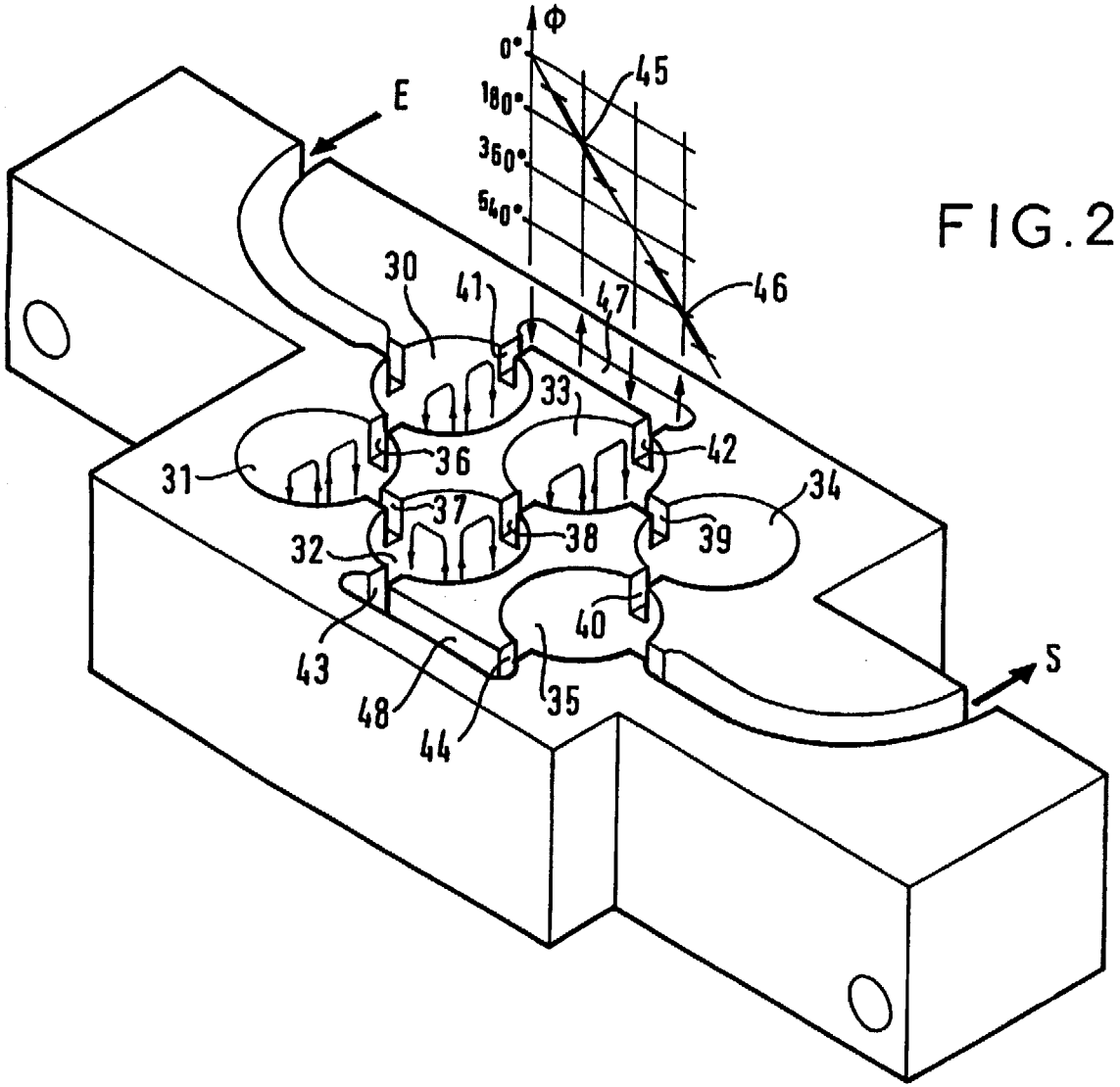
FIG. 2 is a perspective view of one half-shell of a pseudo-elliptical filter with six cavities according to the present invention.

FIG. 2 is a perspective view of one half-shell of a pseudo-elliptical filter of the present invention, the other half-shell being symmetrical to that shown.

In accordance with the invention, the various retro-couplings between cavities of a pseudo-elliptical filter are implemented by waveguides of appropriate dimensions so that, for retro-coupling between two cavities, the electric or magnetic field conveyed from one cavity to the other via said waveguide is ideally of the opposite phase to the same field present in said other cavity.

For example, referring to FIG. 2, for a filter comprising six cavities 30 through 35 positively coupled by irises 36 through 40, a signal input E and a signal output S, two retro-couplings are implemented, between the cavities 30 and 33, on the one hand, and the cavities 32 and 35, on the other hand, via respective waveguides 47 and 48. In the direction of signal flow, the waveguide 47 connects the cavities 30 and 33 and the waveguide 48 connects the cavities 32 and 35. In the embodiment shown, each waveguide has iris ports, i.e. it communicates with the cavities 30 and 33 (32 and 35) via irises 41 and 42 (43 and 44, respectively), the retro-couplings being effected at the level of the magnetic fields. The waveguide is disposed parallel to a line tangent to the two cavities connected by the waveguide and intersecting the two cavities at the iris ports. The magnetic fields are shown in a few of the cavities, the resonance mode here being the $H_{011}$ mode. The waveguides are not resonant and merely convey the components of the signals fed to their ports.

Referring more particularly to the waveguide 47, for which the characteristic curve of the phase $\phi$ of the magnetic field as a function of the length of the waveguide 47 is shown (the phase $\phi$ is a linear function of the distance along the waveguide 47), it is seen that at certain distances from the iris 41 the phase $\phi$ of the magnetic field from the cavity 30 conveyed in the waveguide 47 is a multiple of $k.\pi$ where k is odd. This means that it is possible to define areas 45 and 46 for which the magnetic field from the cavity 30 conveyed in the waveguide 47 has substantially the opposite phase to the magnetic field in the cavity near the iris 42. The magnetic field lines are then in opposite directions. The same applies to the waveguide 48 connecting the cavities 32 and 35. Here, the length and cross-section of the waveguides 47 and 48 are such that the magnetic field from one cavity rotates 540° in the waveguide between the irises 41 and 42 (43 and 44, respectively).

Thus retro-couplings are implemented in waveguide technology, optimal retro-coupling being obtained when the magnetic field from a waveguide has the opposite phase to that near the wall of a cavity to which the waveguide leads.

The cross-section (a) of the waveguide, i.e. the depth to which the half-shell shown is machined, conditions the slope of the FIG. 2 characteristic. This slope is limited by the cut-off frequency of the waveguide $\lambda_c=2a$ and by the double mode $\lambda_c=a$. The waveguide cross-section is determined according to the difference between two cavities, to be more precise according to the distance between two cavity ports to be retro-coupled, to obtain opposite phases of the signals of the cavities at the level of the retro-coupling ports.

The invention described thus far is applied to retro-coupling at the level of the magnetic field but it is also possible to effect retro-coupling at the level of the electric field. In this case, a pin (antenna) is provided at the end of each waveguide to couple the electric field ($H_{10}$ mode, for example).

Figure 3:
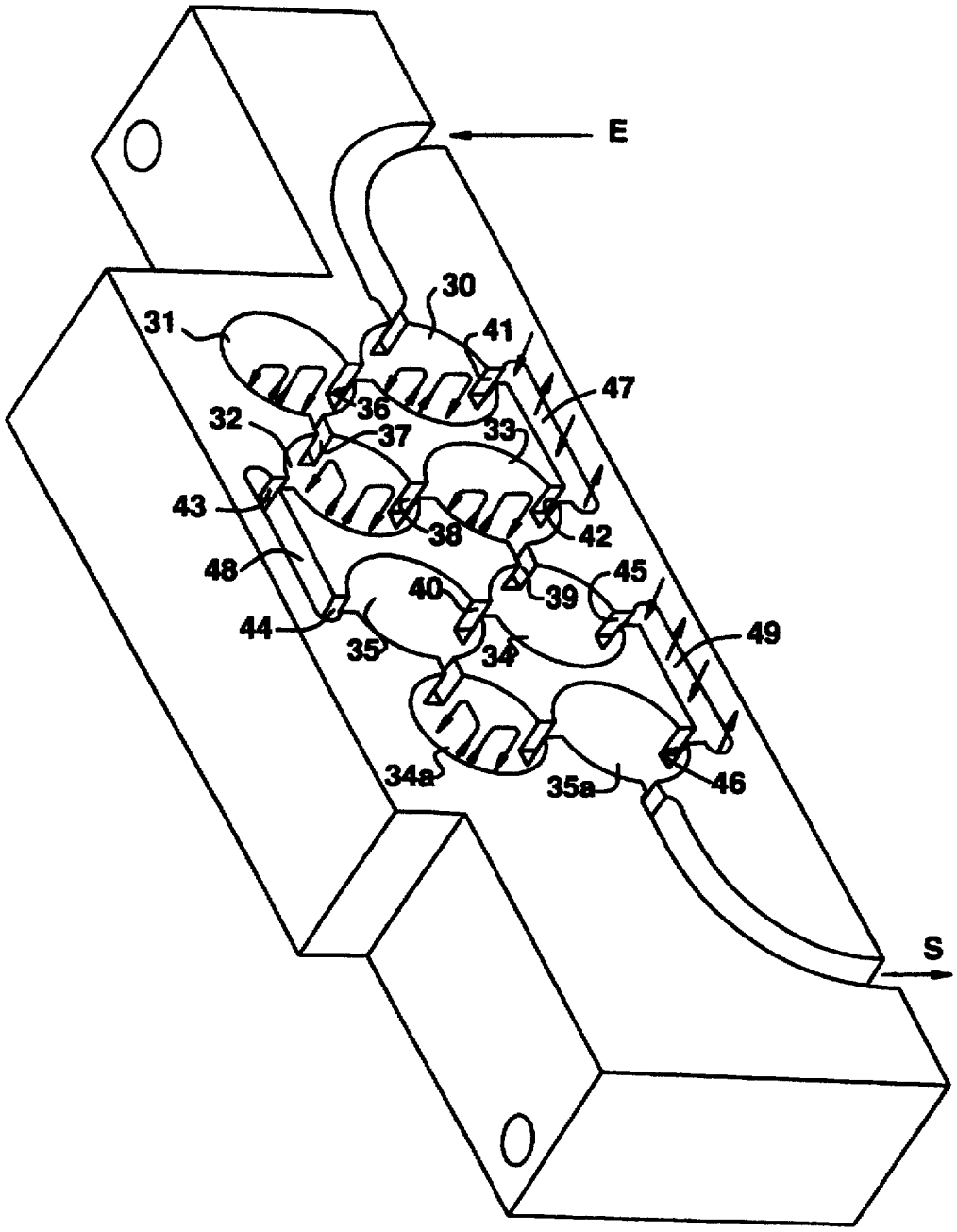
FIG. 3 is a perspective view of one half-shell of a pseudo-elliptical filter with eight cavities according to the present invention.

As already mentioned, in the case of a filter with six resonant cavities, and in the signal flow direction, two waveguides advantageously connect the cavities 30 and 33 and 32 and 35, respectively. A similar result can be obtained by retro-coupling the cavities 31 and 34 using a longer waveguide. In the case of a filter with eight cavities, as shown in FIG. 3 retro-coupling is obtained between the cavities 30 and 33 (47), 32 and 35 (48), 34 and 35*a* (49). Reference may be had to the article "Synthesis of Microwave Bandpass Filters with Zolotarev Characteristics" by A. S. Belov and Yu. S. Ukraintsev, published in JTT Telecommunications & Radio Eng. Part 1, SO Vol. 36, No. 3, March 1982, pp. 44–49, which describes other retro-coupling possibilities.

Other retro-coupling configurations are naturally feasible, for example those shown in the previously mentioned U.S. Pat. No. 4 772 863.

Note that the signal inputs and outputs of each cavity are at 90° to each other and in this case the most troublesome unwanted mode ($E_{111}$) is eliminated. Implementing a filter for the resonance mode $H_{011}$ has the advantage of a high Q.

The invention applies particularly to pseudo-elliptical filters operating in the millimeter band (at frequencies between 20 GHz and 100 GHz), but may be used at higher frequencies.

There is claimed:

1. A pseudo-elliptical filter comprising positively coupled resonant cavities, the signal input and the signal output of each cavity being at 90° to each other, and at least one negative retro-coupling constituted by a waveguide between two of said cavities, the phase difference of the signals at the extremities of said waveguide being approximately a multiple of k*180°, with k being odd.

2. The filter claimed in claim 1 wherein said waveguide has iris ports and said retro-coupling is effected at the level of a magnetic field.

3. The filter claimed in claim 1 wherein said waveguide has pin ports and said retro-coupling is effected at the level of an electric field.

4. A pseudo-elliptical filter comprising:

a plurality of positively coupled cylindrical resonant cavities, wherein the respective signal input and signal output of each of said resonant cavities are orthogonal with respect to each other; and a negative retro-coupling comprising a single, linear waveguide operatively coupling two of said cavities, the phase difference of the signal input and the signal output of said waveguide being approximately a multiple of k*180°, with k being odd.

5. The filter claimed in claim 4, wherein said linear waveguide is disposed parallel to a line tangent to said two of said cavities and intersecting said two of said cavities at ports communicating with said waveguide.

6. The filter claimed in claim 4, wherein said linear waveguide rotates a wave propagated by said linear waveguide by 540°.

7. The filter claimed in claim 4, wherein said linear waveguide includes iris ports and wherein said retro-coupling is effected at the level of a magnetic field.

8. The filter claimed in claim 4, wherein said linear waveguide includes pin ports and wherein said retro-coupling is effected at the level of an electric field.

9. The filter claimed in claim 4, wherein said two cavities are separated from one another by another cavity.

10. The filter claimed in claim 4, wherein said negative retro-coupling is a first retro-coupling and said filter further comprises a second retro-coupling, said second retro-coupling comprising a single, linear waveguide operatively coupling two of said cavities said two cavities coupled by said second retro-coupling being different cavities from the two cavities coupled by said first retro-coupling.

11. The filter claimed in claim 4, wherein said negative retro-coupling is a first retro-coupling and said filter further comprises a second and a third retro-coupling, each of said second and third retro-couplings comprising a single, linear waveguide operatively coupling two of said cavities, said second retro-coupling coupling two cavities different from the cavities coupled by said first retro-coupling and the cavities coupled by said third retro-coupling, said third retro-coupling coupling two cavities different from the two cavities coupled by said first retro-coupling and the two cavities coupled by said second retro-coupling.

12. A single piece pseudo-elliptical filter formed by a process including steps for:

(a) machining a plurality of positively coupled cylindrical resonant cavities, wherein the respective signal input and signal output of each of said resonant cavities are orthogonal with respect to each other; and (b) machining at least one negative retro-coupling, wherein said retro-coupling includes a single, linear waveguide operatively coupling two of said cavities.

13. The filter claimed in claim 12, wherein said linear waveguide is disposed parallel to a line tangent to said two of said cavities and intersecting said two of said cavities at ports communicating with said waveguide.

14. The filter claimed in claim 14, wherein said linear waveguide rotates a wave propagated by said linear waveguide by 540°.

15. The filter claimed in claim 12, wherein said linear waveguide is machined to include iris ports and wherein said retro-coupling is effected at the level of a magnetic field.

16. The filter claimed in claim 12, wherein said linear waveguide includes pin ports and wherein said retro-coupling is effected at the level of an electric field.

* * * * *